United States Patent [19]

Zitz et al.

[11] 4,167,998

[45] Sep. 18, 1979

[54] ARRANGEMENT FOR TENSIONING A GATEWAY CONVEYOR IN A SLOPING GATEWAY

[75] Inventors: Alfred J. Zitz; Heinrich Süssenbeck; Gerhard Stummer, all of Zeltweg, Austria

[73] Assignee: Vereinigte Osterreichische Eisen- und Stahlwerke-Alpine Montan Aktiengesellschaft, Vienna, Austria

[21] Appl. No.: 814,887

[22] Filed: Jul. 12, 1977

[30] Foreign Application Priority Data

Jul. 15, 1976 [AT] Austria ..... 5220/76

[51] Int. Cl.[2] ..... B65G 15/30

[52] U.S. Cl. ..... 198/813; 198/735; 198/861; 299/33; 405/291

[58] Field of Search ..... 198/309, 520, 735, 813, 198/860–862, 864; 299/18, 43–45, 64–67, 33, 34; 61/45 D

[56] References Cited

U.S. PATENT DOCUMENTS

| | | | |
|---|---|---|---|
| 3,113,661 | 12/1963 | Linke et al. | 198/862 |
| 3,504,944 | 4/1970 | Holz et al. | 299/34 |

FOREIGN PATENT DOCUMENTS

| | | | |
|---|---|---|---|
| 1115208 | 10/1961 | Fed. Rep. of Germany | 198/813 |
| 2146811 | 3/1973 | Fed. Rep. of Germany | 61/45 D |
| 2222018 | 11/1973 | Fed. Rep. of Germany | 61/45 D |
| 2231848 | 1/1974 | Fed. Rep. of Germany | 198/862 |
| 2320557 | 11/1974 | Fed. Rep. of Germany | 61/45 D |

*Primary Examiner*—Joseph E. Valenza

*Attorney, Agent, or Firm*—Cushman, Darby & Cushman

[57] ABSTRACT

An arrangement for tensioning a gateway conveyor in a sloping gateway during longwall working using supports having base frames which are provided with pulling and shifting hydraulic actuators, wherein in a tensioning device is provided at least at one of the supports and is connected at one end to the gateway conveyor and at the other end to a slide member which is slidably guided by the base frame of the support for a movement which is transverse to the longitudinal direction of the gateway conveyor, characterized in that the slide member which is slidably guided for a movement which is transverse to the longitudinal direction of the gateway conveyor consists of a guide frame, which is supported by the base frame against forces acting in the longitudinal direction of the gateway conveyor, the cylinder of the pulling and shifting actuator is axially immovably mounted in the base frame and its piston is connected to said guide frame, which when retracted extends on opposite sides of the pulling and shifting actuator and a link is pivoted to the guide frame on a horizontal axis and held against angular movement in the longitudinal direction of the gateway conveyor and is connected to the tensioning device.

9 Claims, 6 Drawing Figures

Figure 2:
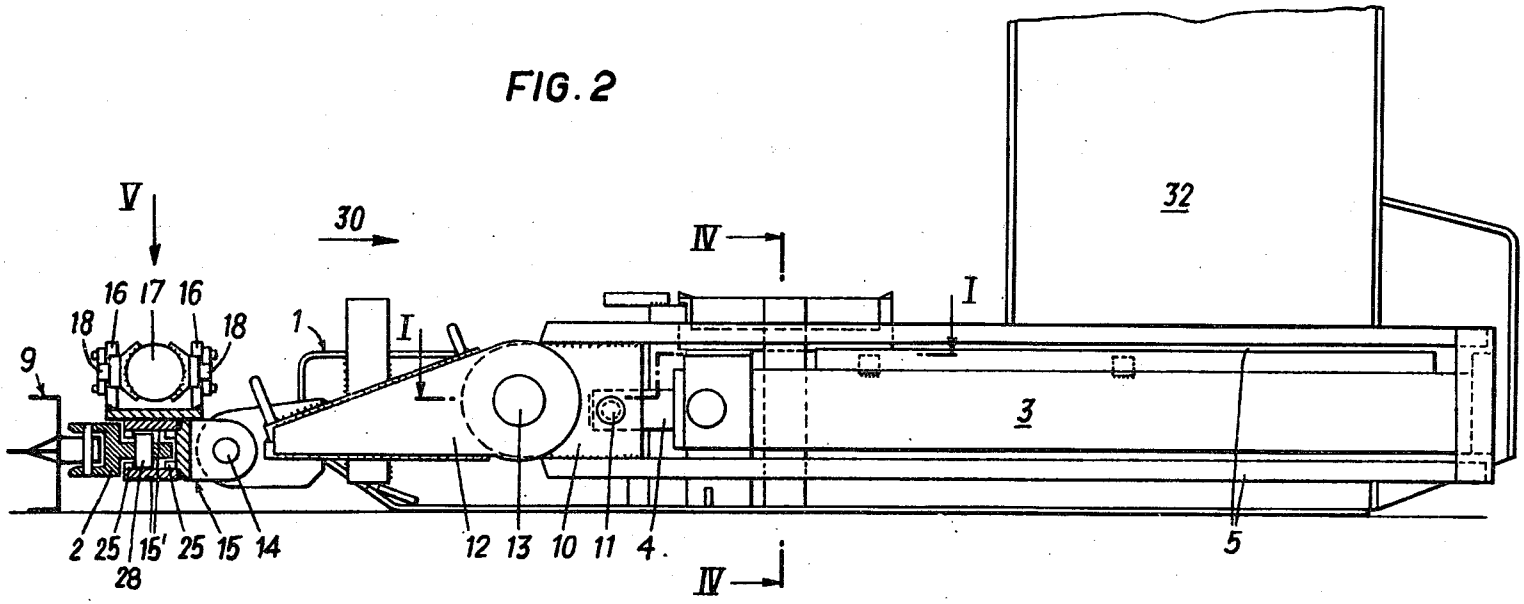

FIG. 1
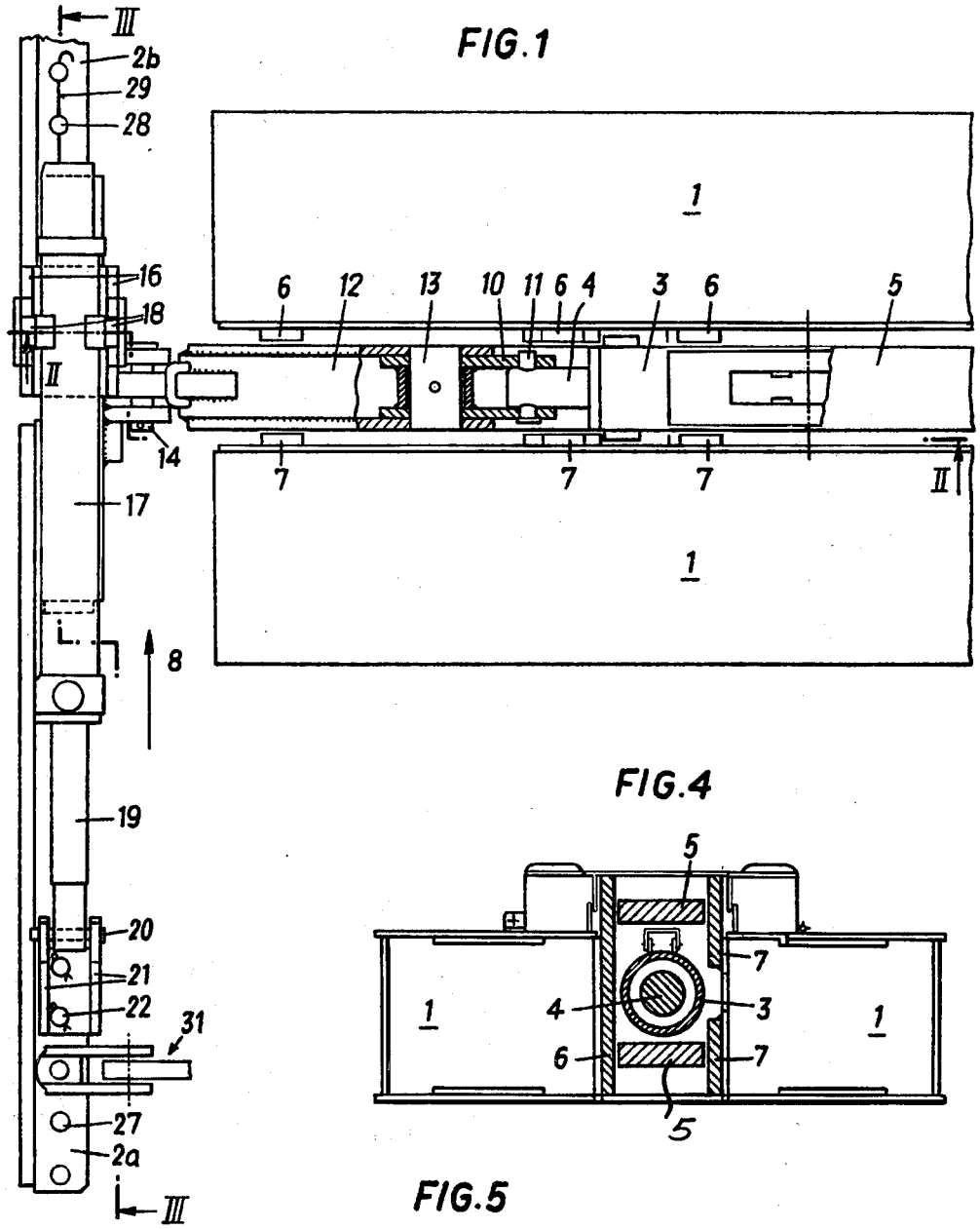
FIG. 4
FIG. 5
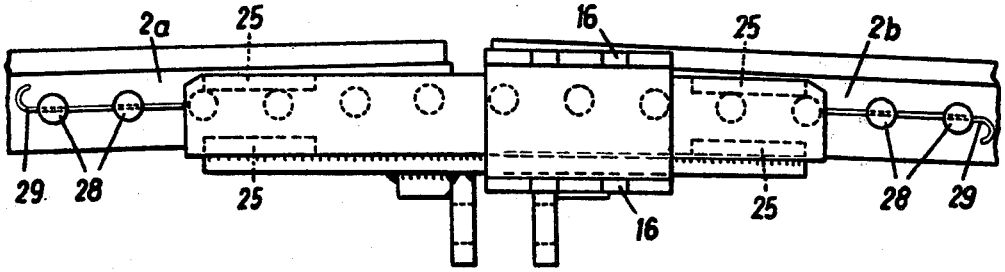

ARRANGEMENT FOR TENSIONING A GATEWAY CONVEYOR IN A SLOPING GATEWAY

During longwall working in a sloping gateway, the gateway conveyor tends to slip in the direction of slope. Such slipping involves severe disadvantages. The delivery of all material is no longer ensured. The gateway conveyor must be extended in its upper end so that in arrangements in which the supports near the face are mechanically shifted and the base frames of the supports are connected by means of pulling and shifting hydraulic actuators to the stop bars of the longwall conveyor, the connections of these actuators must be continually changed. These disadvantages have previously been alleviated by the provision of a tensioning station in the uppermost section of the gateway conveyor but this has the disadvantage that the tensioning station has a large space requirement so that the available gateway cross-section is greatly restricted. It has already been suggested to provide the supports with tensioning devices which are connected at one end to the gateway conveyor and at the other end to the base frames of the supports. The supports are provided with pulling and shifting hydraulic actuators, by which the gateway conveyor can be shifted ahead toward the face as the working proceeds, as long as the supports are forced against the roofs, and by which the support frame itself can be pulled toward the gateway conveyor when the caps previously forced against the roofs have been lowered. For this reason the base frame of each support must contain a slide member which is slidable transversely to the gateway conveyor and to which the tensioning device is connected. It is difficult to support that slide member because the tensioning device exerts considerable forces. In known arrangements of this kind the pulling and shifting actuator is mounted in a slide member so that only relatively small pulling and shifting actuators may be used, which do not withstand the stresses applied.

The present invention relates to such arrangement for tensioning a gateway conveyor in a sloping gateway face during longwall working using supports having base frames which are provided with pulling and shifting hydraulic actuators, wherein a tensioning device is provided at least at one of the supports and is connected at one end to the gateway conveyor and at the other end to a slide member which is slidably guided by the base frame of the support for a movement which is transverse to the longitudinal direction of the gateway conveyor, and it is an object of the invention to avoid these disadvantages. The invention essentially resides in that the slide member which is slidably guided for a movement transverse to the longitudinal direction of the longwall face conveyor consists of a guide frame, which is supported by the base frame against forces acting in the longitudinal direction of the gateway conveyor, the pulling and shifting actuator is axially immovably mounted in the base frame and its piston is connected to said guide frame which when retracted is connected to said guide frame which when retracted extends on opposite sides of the pulling and shifting actuator, and a link is pivoted to the guide frame on a horizontal axis and held against angular movement in the longitudinal direction of the gateway conveyor and is connected to the tensioning device. Because the cylinder of the pulling and shifting actuator is axially immovably fixed to the base frame, that cylinder may be designed as large as it is required in view of the stresses which are applied as the support frame is pulled toward the gateway conveyor and as the latter is shifted transversely to its longitudinal direction. Because the guide frame extends on opposite sides of the pulling and shifting actuator, the guide frame can be guided in the base frame of the support over a large length and can be effectively supported in its retracted and extended positions to take up the tensile forces acting in the longitudinal direction of the gateway conveyor, and the guide frame can be displaced over a large distance. Since the piston is connected to that guide frame, the piston and cylinder are relieved from all transverse horizontal forces. Because the link is pivoted to the guide frame on a horizontal axis, the surface irregularities of the gateway floor can be accommodated, so that transverse vertical forces are avoided. In a preferred embodiment of the invention, that guide frame in its retracted position extends substantially as far as to that end of the base frame which is remote from the gateway conveyor so that the length in which the guide frame is guided in the base frame can be utilized as fully as possible.

In a preferred embodiment of the invention the guide frame comprises two platelike beams, which respectively extend above and below the pulling and shifting actuator and bear literally against the base frame and at those ends of said beams which face the gateway conveyor are connected by a crosshead, to which the link is pivoted. These platelike beams have a high stiffness in a horizontal direction and are of a small height so that these beams can be disposed above and below the pulling and shifting actuator, respectively, without an increase of the overall height of the base frame beyond the extent which is anyway required to ensure the required strength thereof.

The tensioning device consists preferably of a tensioning hydraulic actuator, the cylinder of which is pivoted to the link on a horizontal axis which is transverse to the longitudinal direction of the gateway conveyor whereas the piston of the tensioning actuator is pivoted to the stop bar of the gateway conveyor on a horizontal axis which is transverse to the longitudinal direction of the gateway conveyor. Owing to these pivotal connections, the tensioning device is independent from the position of the base frame and, consequently, from surface irregularities of the gateway floor.

In accordance with the invention the support may be provided at the joint between two stop bars; in that case the piston rod of the tensioning actuator is pivoted to that stop bar which extends downwardly from the joint in the direction in which the gateway is inclined, near the upper end of that stop bar. In that case, it is preferred within the scope of the invention to provide a cross-member, which is pivoted to the link and is slidably guided by the stop bar of the gateway conveyor in the longitudinal direction thereof and is supported by the stop bar against forces acting transversely to the longitudinal direction of the gateway conveyor, and the cylinder of the tensioning actuator is pivoted to said cross-member. In this arrangement, the piston rod of the pulling and shifting actuator is connected to the stop bar of the gateway conveyor by a tension-resisting joint so that the support frame can be pulled up to the gateway conveyor whereas the tensioning movement is not obstructed. When the support together with the piston, which is supported at the base frame in the longitudinal direction of the gateway conveyor, is disposed at the joint between two stop bars, the cross-member is guided at both ends of adjacent stop bars and these are free to perform a limited angular movement relative to the cross-member. This freedom of vertical angular movement allows for surface irregularities of the gateway floor, and the freedom of angular movement in the transverse direction allows for a deviation from a straight line. Because the ends of the adjacent stop bars are guided in the cross-member, the continuity of the gateway conveyor is preserved. That cross-member has suitably a laterally open passage, in which the stop bars are fitted with a clearance. Within the scope of the invention, the stop bars are preferably formed with holes, which slidably receive vertical pins, which have a length that is equal to the height of the passage, the passage is provided on both sides with inwardly projecting ribs, the adjacent faces of which are vertically spaced apart by a distance which is smaller than the length of the pins, the pins are held against falling down out of the holes, the ends of the passage are preferably conically flared, and the pins are guided in the passage between the inwardly projecting ribs with a lateral play. In this way a perfect guidance of the ends of the stop bars in the passage of the cross-member is enabled and an angular misalignment of the stop bar to a permissible extent is accommodated.

Depending on the steepness of the gateway, any desired number of supports may be provided with such tensioning devices. In a steeper gateway, these supports provided with tensioning devices are spaced smaller distances apart so that the tensile forces acting on the gateway conveyor are taken up at a plurality of points and an elastic elongation of the gateway conveyor is virtually avoided. It is particularly important that a separate tensioning station in the uppermost section of the gateway conveyor is no longer required.

Figure 3:
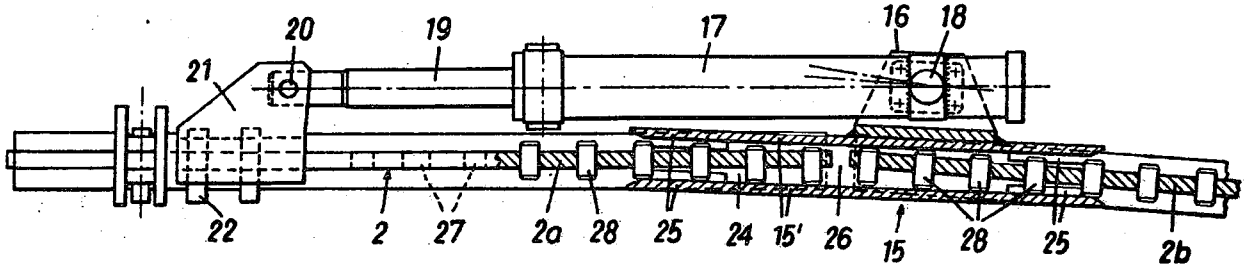
Figure 6:
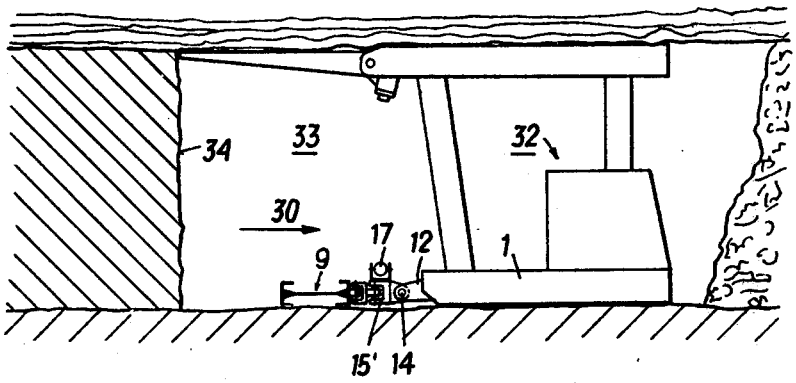

An embodiment of the invention is shown diagrammatically and by way of example on the accompanying drawings, in which FIG. 1 is a top plan view showing a base frame of a support and the chassis of a gateway conveyor, partly in a section taken on line I—I in FIG. 2, FIG. 2 is a sectional view taken on line II—II in FIG. 1, FIG. 3 is a sectional view taken on line III—III in FIG. 1, FIG. 4 a sectional view taken on line IV—IV in FIG. 2, FIG. 5 an elevation showing the conveyor frame and the cross-member as viewed in the direction of arrow V in FIG. 2 with the tensioning actuator removed, and FIG. 6 is a transverse sectional view showing the gateway and a support which is provided with a tensioning device.

In the drawings, a base frame of a support, e.g. a frame support, is designated 1. A gateway conveyor 9 consisting, e.g. of a chain conveyor, comprises a stop bar 2. For the sake of simplicity, only the frame of the gateway conveyor 9 is shown. The stop bar 2 is connected to that conveyor frame. A cylinder 3 of a pulling and shifting actuator is mounted in the base frame 1 and held against displacement in the axial direction of the actuator. The piston of the pulling and shifting actuator is designated 4.

A guide frame 5, 10 is guided in the base frame 1 to be slidably movable in the direction of the axis of the pulling and shifting actuator 3,4. That guide frame comprises two elongated plates 5, which are rigidly connected to a crosshead 10 and are, e.g. welded to the latter. That guide frame 5,10 is supported by plates 6 and 7 of the base frame 1 against longitudinal forces acting on the gateway conveyor 9 in the direction indicated by the arrow 8. The piston 4 is pivoted by a pin 11 to the crosshead 10 of the guide frame 5,10. A link 12 is pivoted to the crosshead 10 by a pin 13 which lies on a horizontal axis. The pin 13 is so strong that the link 12 is held against an angular movement in the direction of the arrow 8 (FIG. 1) relative to the crosshead 10 so that the link 12 can take up all forces transmitted from the gateway conveyor 9 in the direction of the arrow 8 and the cylinder 3 and the piston 4 of the pulling and shifting actuator will not be laterally loaded.

A cross-member 15 is pivoted to the link 12 on a horizontal axis by a pin 14. A cylinder 17 of a tensioning actuator is mounted on said cross-member between two cheeks 16, in which the cylinder 17 is pivoted on two pins 18. The piston 19 of the tensioning actuator is pivoted by a pin 20 to lugs 21, which are secured by pins 22 to the stop bar 2 of the gateway conveyor 9. Owing to this arrangement the stop bar 2 of the conveyor can be pushed by the tensioning actuator 17, 19 opposite to the arrow 8 in FIG. 1.

The cross-member 15 has two walls 15', which enclose a cavity or passage. The passage 24 is open toward the stop bar 2 and is provided on both sides with inwardly projecting ribs 25. The base frame 1 of the support is disposed at the joint 26 between two stop bars **2*a* and 2*b* and the ends of these two stop bars 2*a* and 2*b* are guided in the passage 24 with a clearance. The stop bar 2 (2*a* or 2*b*) has holes 27, and pins 28 are slidably mounted in said holes 27 adjacent to the cross-member 15. The pins 28 have bores, through which a wire 29 (FIG. 5) is threaded to hold the pins 28 against falling out downwardly. Gravity prevents the pins 28 from falling out upwardly. The length of these pins is as large as the height of the passage 24. As a result, a slight angular misalignment of the two stop bars 2*a* and 2*b* relative to each other is enabled so that the stop bar and the gateway conveyor 9 can adapt themselves to surface irregularities of the gateway floor. The distance between the adjacent surfaces of the two inwardly projecting ribs 25 is smaller than the length of the pins 28 so that the latter are laterally held. As is apparent from FIG. 5, the passage 24 is so wide that there is a small freedom of lateral angular movement so that a small angular misalignment of the stop bars 2*a* and 2*b* relative to each other is also enabled. The guidance in the passage 24 limits the angular misalignment in both senses, and the engagement of the pins 28 with the inwardly projecting ribs 25 permits the piston 4 to exert a pulling force on the stop bar 2 in the direction of the arrow 30 and a pushing force opposite to the direction of the arrow 30**.

FIG. 6 is a transverse sectional view showing the gateway 33 with a frame support 32 and the gateway conveyor 9. By means of the pulling and shifting actuator 3,4 the support 32 can be pulled to the gateway conveyor 9 in the direction toward the face 34 during the pulling step, and the gateway conveyor 9 can be pushed ahead toward the face 34 opposite to the direction of the arrow 30.

The adjacent supports may be designed as usual. The connection of the piston of the pulling and shifting actuator of an adjacent support to one of the holes 27 of the stop bar 2 is indicated at 31.

What we claim is:

1. An arrangement for tensioning a gateway conveyor in a sloping gateway during longwall working using supports having base means which are provided with pulling and shifting hydraulic cylinder actuators, wherein a tensioning device is provided at least at one of the supports and is connected at one end to the gateway conveyor and at the other end to a slide member which is slidably guided by the base means of the support for movement which is transverse to the longitudinal direction of the gateway conveyor, characterized in that the slide member comprises a guide frame which is supported by the base means against forces acting in the longitudinal direction of the gateway conveyor, the cylinder of the pulling and shifting actuator being axially immovably mounted in the base means, said actuator including a piston connected to said guide frame, which piston when retracted positions said guide frame so that it extends over the pulling and shifting cylinder and said arrangement being further characterized in that a link is connected to said tensioning device and is pivoted by means of a pivot pin to said guide frame for movement about a horizontal axis, said pivot pin holding said link against angular movement in the longitudinal direction of the gateway conveyor.

2. An arrangement as claimed in claim 1, characterized in that the guide frame in its retracted position extends substantially as far as that end of the base means which is remote from the gateway conveyor.

3. An arrangement as claimed in claim 1, characterized in that the guide frame comprises two platelike beams which respectively extend above and below the pulling and shifting actuator and bear laterally on the base means and at those ends of said beams which face the gateway conveyor are connected by a crosshead to which said link is pivoted.

4. An arrangement as claimed in claim 1, characterized in that the tensioning device includes a tensioning hydraulic actuator, the cylinder of which is pivoted to said link said link being disposed transverse to the longitudinal direction of the gateway conveyor, and the piston of the tensioning actuator is pivoted to a stop bar of the gateway conveyor on a horizontal axis which is transverse to the longitudinal direction of the gateway conveyor.

5. An arrangement as claimed in claim 1, characterized in that the base means of the support is located at the joint between two stop bars and the piston rod of the tensioning actuator is pivoted to one stop bar which extends downwardly from the joint in the direction in which the gateway is inclined, near the upper end of that stop bar.

6. An arrangement as claimed in claim 1, characterized in that a cross-member is pivoted to said link and is slidably guided by a stop bar of the gateway conveyor in the longitudinal direction of the latter and is supported by the stop bar against forces acting transversely to the longitudinal direction of the gateway conveyor, the cylinder of the tensioning actuator being pivoted to said cross-member.

7. An arrangement as claimed in claim 6, characterized in that the cross-member is guided by both ends of two adjacent stop bars which are free to perform a limited angular movement relative to said cross-member.

8. An arrangement as claimed in claim 7, characterized in that the cross-member has a laterally open passage in which the ends of said stop bars are fitted with a clearance.

9. An arrangement as claimed in claim 8, characterized in that said stop bars are formed with holes which slidably receive vertical pins, said pins having a length that is equal to the height of said passage, said passage being provided on both sides with inwardly projecting ribs the adjacent faces of which are vertically spaced apart by a distance which is smaller than the length of said pins, said pins being held against falling out of said holes, the ends of the passages being conically flared, and said pins being guided in said passage between said inwardly projecting ribs with lateral play.

* * * * *